US005695104A

United States Patent [19]

Darling

[11] Patent Number: 5,695,104

[45] Date of Patent: Dec. 9, 1997

[54] PAINTER'S ACCESSORY HOLDER

[76] Inventor: Michael Darling, 1425 Moutain Rd., Haymarket, Va. 22069

[21] Appl. No.: 662,676

[22] Filed: Jun. 14, 1996

[51] Int. Cl.[6] ..... A45F 5/00

[52] U.S. Cl. ..... 224/684; 224/251; 224/255; 224/673; 224/674; 224/904; D3/228

[58] Field of Search ..... 224/904, 650, 224/663, 665, 673, 674, 676, 677, 680, 681, 682, 683, 684, 232, 234, 251, 255; 24/10 A, 10 R, 11 CC, 11 C, 11 F; D3/220, 228; D8/14.1

[56] References Cited

U.S. PATENT DOCUMENTS

| | | | |
|---|---|---|---|
| D. 258,550 | 3/1981 | Strauss | 224/904 |
| 882,178 | 3/1908 | Sloat . | |
| 2,753,100 | 7/1956 | Montgomery | 224/682 |
| 2,758,798 | 8/1956 | Schmidt . | |
| 3,516,584 | 6/1970 | Fabyan | 224/904 |
| 3,664,560 | 5/1972 | Perkins | 224/914 |
| 4,106,679 | 8/1978 | Hillinger | D3/228 |
| 4,300,708 | 11/1981 | Patterman . | |
| 4,830,247 | 5/1989 | Banks . | |
| 4,986,459 | 1/1991 | Yarbrough et al. | 224/904 |
| 5,040,524 | 8/1991 | Votel et al. | 224/904 |
| 5,052,603 | 10/1991 | Spina | 224/904 |
| 5,385,281 | 1/1995 | Byrd | 224/250 |
| 5,441,185 | 8/1995 | Dragos . | |
| 5,511,703 | 4/1996 | Ryerson | 224/904 |
| 5,568,889 | 10/1996 | Holloway, Jr. et al. | 224/904 |
| 5,582,338 | 12/1996 | Tamura | 224/904 |
| 5,609,283 | 3/1997 | Harrison, Jr. | 224/904 |

*Primary Examiner*—Henry J. Recla
*Assistant Examiner*—Gregory M. Vidovich
*Attorney, Agent, or Firm*—Bacon & Thomas

[57] ABSTRACT

A painter's accessory holder is disclosed for holding painting accessories, such as a caulking gun, sandpaper, glazing compound and a bladed tool on a base member that is attachable to a belt worn by the painter. The accessory holder includes a caulking gun bracket attached to the base member configured to accept a caulking gun, the caulking gun finger guard engaging a portion of the bracket to securely hold the caulking gun in place, while at the same time rendering it easily removable. A sandpaper bracket is attached to the base member to clamp sandpaper between the bracket and the base so as to be securely but removeably held and readily accessible to the painter. The device also may include a pouch attached to the base member to hold a glazing compound and a bladed tool bracket to hold bladed tools, such as putty knives, etc. The bladed tool bracket may be formed by a generally "U" shaped metal bracket which allows the handle of the bladed tool to pass through, but engages the blade portion so as to securely, but removeably, hold the bladed tool. The bladed tool bracket may also be formed by a strip of material which also allows the handle to pass through, but engages the blade portion.

20 Claims, 4 Drawing Sheets

PAINTER'S ACCESSORY HOLDER

BACKGROUND OF THE INVENTION

The present invention relates to a painter's accessory holder, more particularly such a holder that is attachable to a belt worn by the painter and which will hold several painter's accessories, such as a caulking gun, sand paper, putty knife, or the like.

In order to properly paint an interior or exterior surface, it is oftentimes necessary for a painter to fix minor surface imperfections prior to applying the paint. Such surface preparation may involve sanding the surface, applying caulking, applying a glazing compound around windows, removing loose paint, etc. Each of these jobs requires its own unique tool to efficiently carry out the process. In order to minimize the time required for a given painting job, it is necessary for a painter to carry these miscellaneous tools such that they are readily available when needed. This presents a particular problem when the painter is working on a ladder, scaffolding, or the like, where such tools cannot be readily stored.

It is known to provide belts to carry various accessories specifically related to painting. However, these known accessory belts have not proven entirely satisfactory. Such known devices often do not hold the tools in a secure manner and may enable the tools to fall, raising the potential of personal injury. If the known devices do securely attach the tools, it is often difficult to remove the tools from the belt without using both hands, an obvious inconvenience to the painter.

SUMMARY OF THE INVENTION

A painter's accessory holder is disclosed for holding painting accessories, such as a caulking gun, sandpaper, glazing compound and a bladed tool on a base member that is attachable to a belt worn by the painter. The accessory holder includes a caulking gun bracket attached to the base member configured to accept a caulking gun, the caulking gun finger guard engaging a portion of the bracket to securely hold the caulking gun in place, while at the same time rendering it easily removable. A sandpaper bracket is attached to the base member to clamp sandpaper between the bracket and the base so as to be securely held and readily accessible to the painter. The device also may include a pouch attached to the base member to hold a glazing compound and a bladed tool bracket to hold bladed tools, such as putty knives, etc. The bladed tool bracket may be formed by a generally "U" shaped metal bracket which allows the handle of the bladed tool to pass through, but engages the blade portion so as to securely, but removeably, hold the bladed tool. The bracket may also be formed by a strip of material which also allows the handle to pass through, but engages the blade portion.

The base member may have one or more belt loops formed on a rear side so as to be slidable around a belt worn by the painter. Alternatively, the base member may have a plurality of slots to accept the belt therein and to attach the base to the belt.

The caulking gun bracket is located adjacent to a rear edge portion of the base member to position the caulking gun so as not to interfere with the motion of the painter in climbing ladders, or working on scaffolds. At the same time, the caulking gun is readily accessible to the painter and may be removed from the accessory holder with one hand.

The bladed tool holder bracket is located adjacent to a front edge portion of the base and is located below the pouch containing the glazing compound. The location of the pouch above the bladed tool holder prevents inadvertent contact with the bladed tool, thereby preventing injury to the painter. This location also enables the bladed tool to be readily removed from the holder by the painter when necessary.

DETAILED DESCRIPTION OF THE PREFERRED EMBODIMENTS

Figure 1:
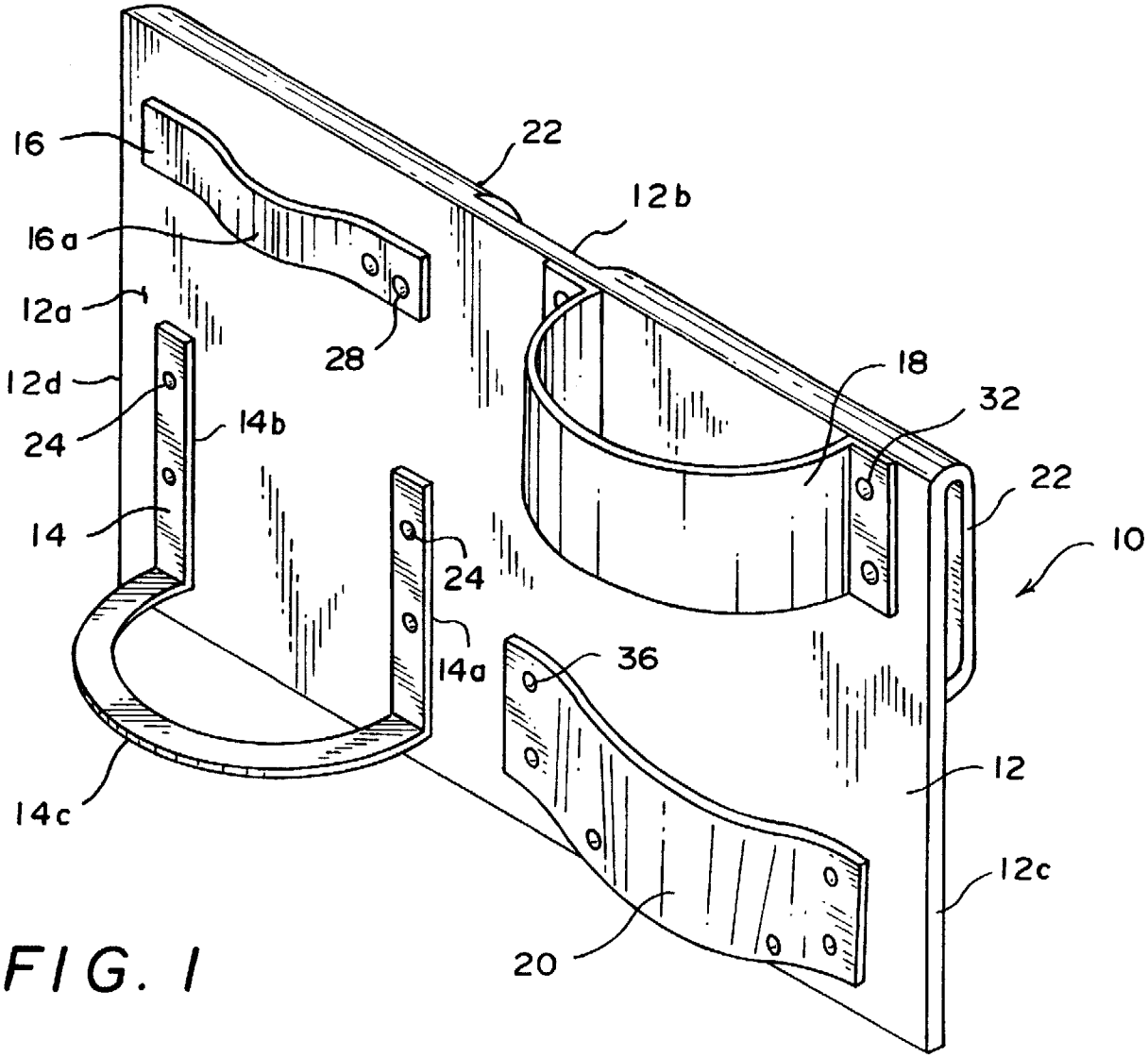
FIG. 1 is a perspective view of a first embodiment of an accessory holder according to the present invention.

The painter's accessory holder is generally illustrated at 10 in FIG. 1 and comprises a base member 12 having a caulking gun bracket 14, a sandpaper bracket 16, a pouch 18, and a bladed tool bracket 20 attached to a first side 12*a*. One or more belt loops 22 are located on and extend from a second side 12*b* of the base member 12. Although two such belt loops 22 are illustrated, quite obviously more or less than this number may be utilized without exceeding the scope of the invention.

The base member 12 may be fabricated from any relatively flexible semi-rigid material such as cowhide, and may have a generally rectangular configuration as illustrated. A preferred embodiment comprises a sheet of plastic foam and two sheets of Cordura (ballistic nylon), with one sheet of Cordura (ballistic nylon) laminated to each side of the sheet of foam. Again, other configurations of the base member may be utilized without exceeding the scope of the invention.

Figure 2:
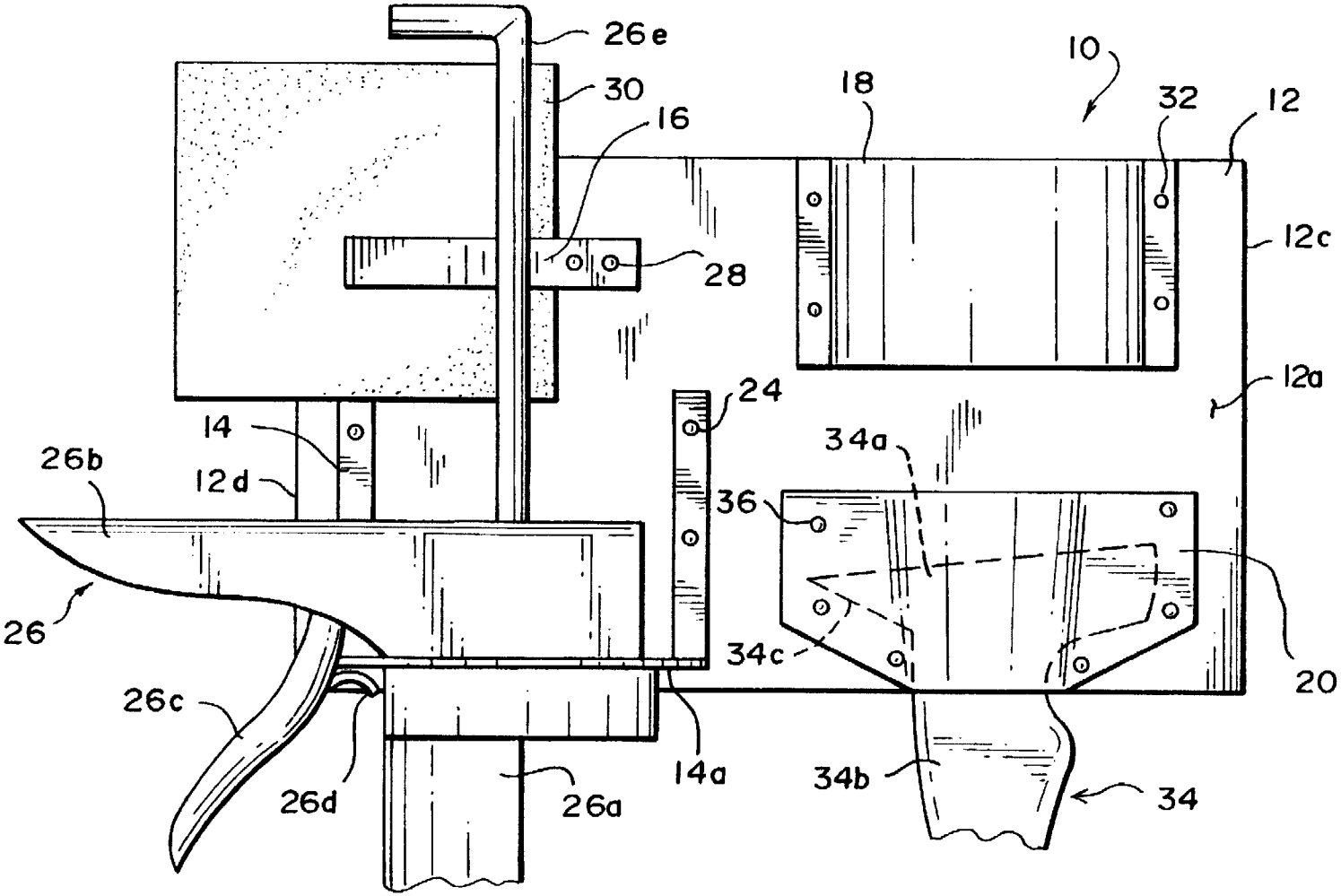
FIG. 2 is a front view of the accessory holder in FIG. 1 with accessories mounted thereon.

The caulking gun bracket 14 has a generally "U" shaped configuration and may be formed of an injection molded plastic or a metallic material, such as rolled steel. The opposite legs 14*a*, 14*b* of the "U" shaped caulking gun bracket 14 are attached to the base member 12 via rivets 24, or any other suitable means. The bottom portion 14*c* of the "U" shape extends outwardly away from the plane of the base member 12 so as to define a space configured to accept a caulking gun therein. As best illustrated in FIG. 2, caulking gun 26, as is well known in the art, has a barrel portion 26*a* which extends through the bottom portion 14*c* of the caulking gun bracket, and a handle portion 26*b* which contacts the caulking gun bracket 14. Handle portion 26*b*, as is also well known in the art, has a movable trigger 26*c* that, in known fashion, is movable with respect to the handle portion 26*b*. A finger guard 26*d* is mounted on the trigger 26*c* near its juncture with the handle 26*b* to prevent the pinching of the user's fingers between the trigger and the handle as the trigger is released. As shown, a portion of the caulking gun bracket 14 is trapped in the space between the finger guard 26*d*, the trigger 26*c* and the handle 26*b*, thereby securely holding the caulking gun 26 in the caulking gun bracket 14. In order to remove the caulking gun for use, it is necessary that the painter compress the trigger 26*c* toward the handle 26*b* which will release the caulking gun from the bracket 14.

The amount of compression to release the caulking gun from the bracket 14 is less than the amount of compression that is required to dispense caulk from the caulking gun. Plunger 26e is shown in the extended position.

The base member 12 has a front edge 12c and a rear edge 12d. The caulking gun bracket 14 is located closer to the rear edge 12d than the front edge 12c so as to position the caulking gun, when the accessory holder is worn by a painter, in such a manner that the caulking gun will not interfere with the painter climbing ladders, walking on scaffolds, etc.

Sandpaper bracket 16 is located above the caulking gun bracket 14 and is also fastened to base member 12 via rivets 28, or any other suitable means. The sandpaper bracket 16 has a slightly bent or crimped portion 16a extending outwardly from the first side 12a of the base member 12 and is formed of a slightly resilient material such that one or more sheets of sandpaper 30 may be inserted between the bracket 16 and the base member 12 and be held in place by the bracket 16. The sandpaper 30 is readily available to the painter, and is securely, but removeably attached to the accessory holder. The sandpaper may be easily and quickly re-inserted in between bracket 16 and base member 12 after being used by the painter.

The pouch 18 is designed to specifically hold a wood putty or a glazing compound such that this material is readily accessible to the painter and is not hidden in a pocket as in the known devices. The pouch 18 is located adjacent to the front edge 12c of the base member 12 and, again, may be attached to the base member 12 by rivets 32 or any other suitable means. In a preferred embodiment, the sides and bottom of pouch 18 are sewn to base member 12, so that the top of pouch 18 is spaced from surface 12a.

Located below the pouch 18 is bladed tool bracket 20, which may comprise an elongated strip of material having an open upper portion so as to accept therein a bladed tool having a blade portion 34a and a handle portion 34b. The bottom of the bladed tool bracket 20 is also open so as to allow the handle portion 34b to pass through such that the blade portion 34a is engaged by the bracket to hold the tool. The blade portion 34a may have a pointed protuberance 34c extending from one side which is located between two adjacent attaching rivets 36 so as to secure the bladed tool 34 in the bracket 20. The bladed tool is likely to be a five-in-one tool as is well known in the art but may also comprise a putty knife. The bladed tool bracket 20 may be attached to base member 12 by rivets 36 or any other suitable means.

Figure 3:
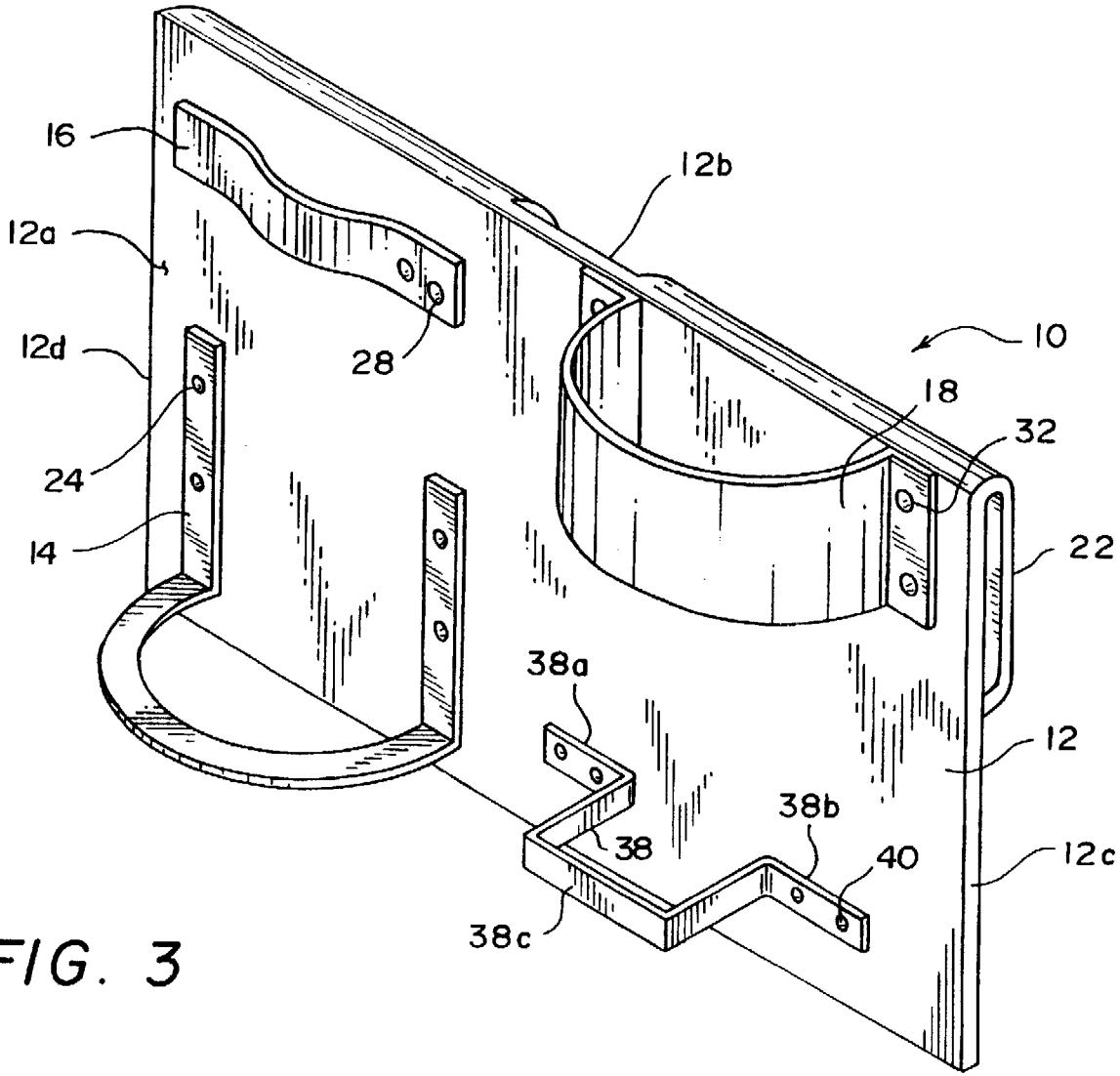
FIG. 3 is a perspective view of a second embodiment of an accessory holder according to the present invention.

A preferred embodiment of the bladed tool bracket 38 is illustrated in FIG. 3 and has a generally "U" shaped configuration with the opposite legs 38a, 38b attached to the base member 12 via rivets 40, or any other suitable means. Bracket 38 may be formed of an injection molded plastic or a metallic material. A center portion 38c of the bracket 38 is displaced away from the surface 12a of the base member 12 to form a space through which may pass the handle portion of the bladed tool, while the wider blade portion engages the bracket. In a preferred embodiment, there are tight tolerances between bracket 38 and the bladed tool, so that a turn of the bladed tool removably engages the bladed tool in bracket 38.

The location of the bladed tool bracket 20 or 38 directly below the pouch 18 serves to prevent inadvertent contact with the bladed tool which may have a sharpened edge because pouch 18 extends outward from surface 12a and pouch 18 is wider than the sharpened edge of the bladed tool. Such a location also enables the painter ready access to the tool should this become necessary. The bladed tool bracket 38 may be fabricated from an injection molded plastic or a metal, such as rolled steel.

Figure 4:
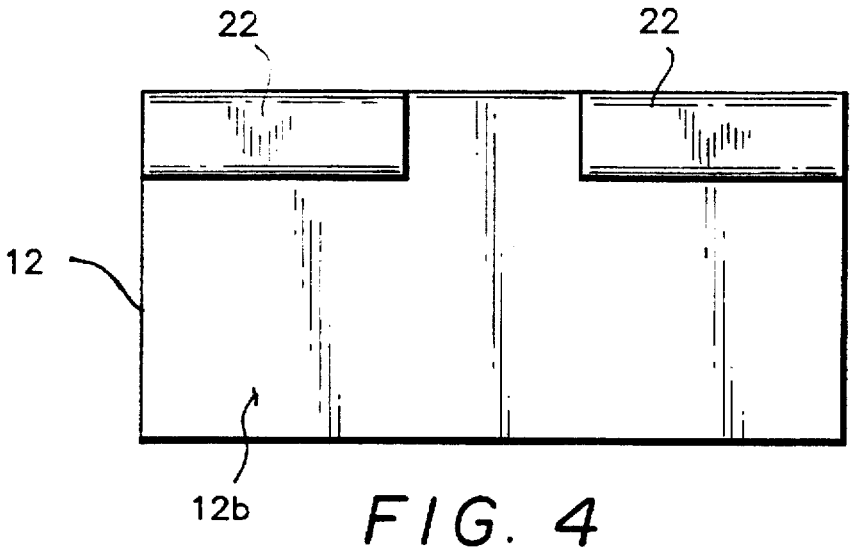
FIG. 4 is a rear view of an accessory holder according to the present invention illustrating a first belt attachment.
Figure 5:
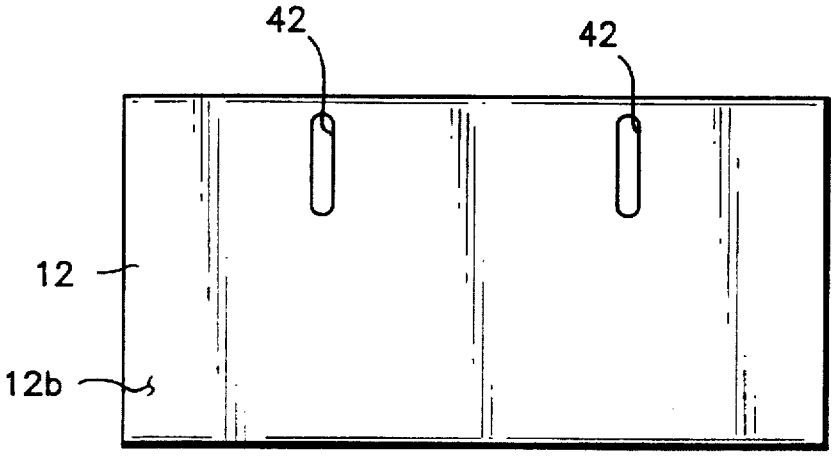
FIG. 5 is a rear view of an accessory holder according to the present invention illustrating a second belt attachment.
Figure 6:
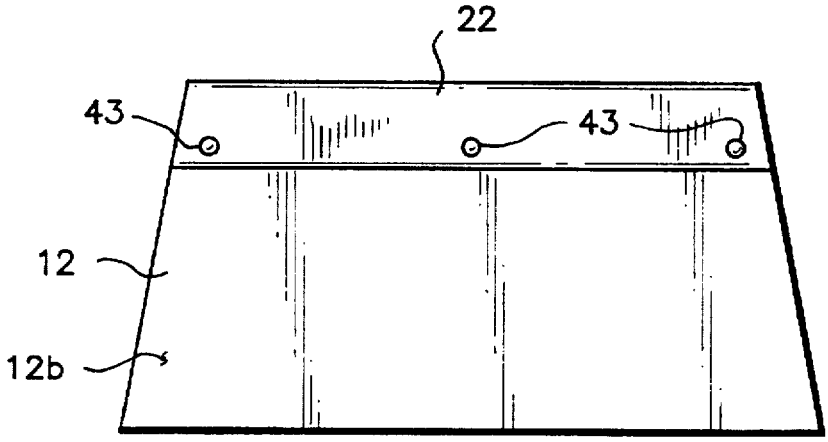
FIG. 6 is a rear view of an accessory holder according to the present invention illustrating a third belt attachment.

FIG. 4 is a rear view of the accessory holder illustrating the belt loops 22 and the rear surface 12b. Alternatively, as shown in FIG. 5, the base member 12 can be formed with one or more slots 42 so as to enable the accessory holder to be attached to a belt worn by the painter. In a preferred embodiment of the invention, as shown in FIG. 6, the top of the base member 12 is slightly narrower than the bottom with one continuous belt loop 22 that is attached to base member 12 by rivets 43, whereby belt loop 22 may fit between belt loops (not illustrated) on the painter's pants.

In another embodiment of the invention, a base member is provided with a sandpaper bracket located above a caulking gun bracket, but without a pouch or a bladed tool bracket.

The embodiments of the invention shown in the drawings and described above are for a right-handed painter, to be worn on the right side of the painter. Corresponding embodiments for left-handed painters would be reversed to be worn on the left side of the painter, so that the sandpaper bracket has the open end facing to the rear of the painter, and the caulking gun bracket is toward the rear of the base member as worn by the painter.

Other embodiments of the invention will be readily apparent to those of ordinary skill in the art and are included within the scope of the invention.

The foregoing description is provided for illustrative purposes only and should not be construed as in any way limiting this invention, the scope of which is defined solely by the appended claims.

What is claimed is:

1. A painter's accessory holder for supporting a caulking gun having a handle, a trigger movably connected to the handle at one end thereof between first end second positions, and a finger guard connected to the trigger proximate the one end so as to define a space bound by the handle, the trigger, and the finger guard when the handle is in the first position, the holder comprising:

a) a base member having first and second generally opposite facing sides;

b) attachment means configured to attach the base member to a belt worn by the painter; and c) a caulking gun bracket attached to the first side of the base member, the bracket having a portion spaced from the first side of the base member configured to accept a caulking gun therein such that when the trigger is in the first position, a portion of the bracket is entrapped in the space to securely hold the caulking gun in the caulking gun bracket and when the trigger is in the second position, the caulking gun is releasable from the bracket.

2. The painter's accessory holder of claim 1 further comprising a sandpaper bracket attached to the first side of the base member for holding at least one sheet of sandpaper between the sandpaper bracket and the first side of the base member.

3. The painter's accessory holder of claim 2, wherein the sandpaper bracket comprises a resilient material.

4. The painter's accessory holder of claim 1 further comprising means forming a pouch attached to and extending from the first side of the base member.

5. The painter's accessory holder of claim 1 further comprising a bladed tool bracket attached to the first side of the base member so as to hold a tool having a blade portion and a handle portion.

6. The painter's accessory holder of claim 1 wherein the attachment means comprises at least one belt loop extending from the second side of the base member.

7. The painter's accessory holder of claim 1 wherein the attachment means comprises at least one belt opening through the base member.

8. The painter's accessory holder of claim 1 further adapted to receive a bladed tool having a handle portion and a blade portion wider than the handle portion; and further comprising: an elongated strip having opposite ends attached to the first side of the base member and an intermediate portion spaced from the first side whereby the elongated strip engages the blade portion to support the bladed tool on the base member.

9. The painter's accessory holder of claim 8 wherein at least one end of the elongated strip is attached to the base member by a pair of spaced fasteners located such that at least part of the blade portion extends between the spaced fasteners.

10. The painter's accessory holder of claim 1 wherein the base member has a generally rectangular configuration.

11. The painter's accessory holder of claim 10 wherein the base member has front and rear edges and wherein the caulking gun bracket is located closer to the rear edge than the front edge.

12. The painter's accessory holder of claim 11 further comprising a sandpaper holding bracket attached to the first side of the base member and located closer to the rear edge than the front edge of the base member and above the caulking gun bracket.

13. The painter's accessory holder of claim 12 further comprising a bladed tool bracket attached to the first side of the base member and adapted to receive a tool having a blade portion and a handle portion, the bladed tool bracket located between the caulking gun bracket and the front edge of the base member.

14. The painter's accessory holder of claim 13 further comprising means forming a pouch attached to the first side of the base member and located between the sandpaper holder and the front edge of the base member, and above the bladed tool bracket.

15. The painter's accessory holder of claim 1 further adapted to receive a bladed tool having a handle portion and a blade portion wider than the handle portion; and further comprising: a bladed tool bracket having a generally "U" shaped configuration with opposite legs attached to the first side of the base member, and an intermediate portion spaced from the first side whereby the bladed tool bracket engages the blade portion to support the bladed tool on the base member.

16. The painter's accessory holder of claim 15 wherein there are tight tolerances between the bladed tool bracket and the bladed tool, so that a turn of the bladed tool removably engages the bladed tool in the bladed tool bracket.

17. The painter's accessory holder of claim 1, wherein said caulking gun bracket has a closed, generally "U" shaped configuration.

18. A painter's accessory holder for supporting a caulking gun having a handle, a trigger movably connected to the handle atone end thereof between first and second positions, and a finger guard connected to the trigger proximate the one end so as to define a space bound by the handle, the trigger, and the finger guard when the handle is in the first position, the holder comprising:

a) a base member having first and second generally opposite facing sides;

b) belt slots configured to attach the base member to a belt worn by the painter; and c) a caulking gun bracket attached to the first side of the base member, the bracket having a portion spaced from the first side of the base member configured to accept a caulking gun therein such that when the trigger is in the first position, a portion of the bracket is entrapped in the space to securely hold the caulking gun in the caulking gun bracket and when the trigger is in the second position, the caulking gun is releasable from the bracket.

19. A painter's accessory holder for supporting a caulking gun having a handle, a trigger movably connected to the handle at one end thereof between first and second positions, and a finger guard connected to the trigger proximate the one end so as to define a space bound by the handle, the trigger, and the finger guard when the handle is in the first position, the holder comprising:

a) a base member having first and second generally opposite facing sides;

b) at least one belt loop configured to attach the base member to a belt worn by the painter; and c) a caulking gun bracket attached to the first side of the base member, the bracket having a portion spaced from the first side of the base member configured to accept a caulking gun therein such that when the trigger is in the first position, a portion of the bracket is entrapped in the space to securely hold the caulking gun in the caulking gun bracket and when the trigger is in the second position, the caulking gun is releasable from the bracket.

20. The painter's accessory holder of claim 19, wherein said caulking gun bracket has a closed, generally "U" shaped configuration, and said caulking gun bracket is rigidly attached to the first side of the base member.

* * * * *